US007568444B2

(12) United States Patent
Espeseth et al.

(10) Patent No.: US 7,568,444 B2
(45) Date of Patent: Aug. 4, 2009

(54) FOLDING KAYAK

(75) Inventors: Gordon E. Espeseth, Saskatoon (CA); Gord B. Heisler, Calgary (CA); Bryon J. Heisler, Calgary (CA); Paul R. Crawford, Calgary (CA)

(73) Assignee: Trak Kayaks (Barbados) Ltd., Christ Church (BB)

( * ) Notice: Subject to any disclaimer, the term of this patent is extended or adjusted under 35 U.S.C. 154(b) by 0 days.

(21) Appl. No.: 11/834,588

(22) Filed: Aug. 6, 2007

(65) Prior Publication Data

US 2008/0041295 A1 Feb. 21, 2008

Related U.S. Application Data

(60) Provisional application No. 60/821,699, filed on Aug. 7, 2006.

(51) Int. Cl.
*B63B 35/71* (2006.01)
*B63B 7/00* (2006.01)
*B63B 7/04* (2006.01)

(52) U.S. Cl. ..... 114/347; 114/352; 114/354

(58) Field of Classification Search ..... 114/347, 114/352–354, 363
See application file for complete search history.

(56) References Cited

U.S. PATENT DOCUMENTS 1,822,810 A * 9/1931 Hart ..... 114/354
2,415,495 A 2/1947 Humphreys
3,075,207 A 1/1963 Lewis
4,480,579 A * 11/1984 Masters ..... 114/347
4,715,311 A * 12/1987 Masters ..... 114/347
5,708,232 A * 1/1998 Nedderman, Jr. ..... 114/23
5,875,731 A 3/1999 Abernethy et al.
5,975,006 A * 11/1999 Lewit ..... 114/363
6,371,042 B1 * 4/2002 Abernethy et al. ..... 114/354
6,923,139 B1 * 8/2005 Robichaux et al. ..... 114/347

FOREIGN PATENT DOCUMENTS

DE 360718 C 10/1922

* cited by examiner

*Primary Examiner*—Ajay Vasudeva
(74) *Attorney, Agent, or Firm*—Kenyon & Kenyon LLP

(57) ABSTRACT

A folding kayak includes fore and aft subassemblies which are joined together and are covered by a water-impermeable skin to provide a watercraft with the favorable attributes both hard shell and skin on frame kayaks, with none of the disadvantages. In addition, one or more hydraulic adjustment mechanisms provide the kayak with characteristics of a plurality of different rigid body kayaks, with different operational characteristics, suitable for open-ocean or closed-water environments as desired. Ribs which are part of the kayak assembly have a relatively flat profile, making the kayak perform more favorably in adverse water conditions, and also giving the kayak some resilience and flexibility when encountering obstructions in the water. In one aspect, the kayak subassemblies may be joined, at least in part, by corrugated splines. By rotating these corrugated splines within elongate tubes that form part of the respective subassemblies, it is possible to remove crystalline, corrosive, and other build-up. The kayak may be disassembled into a relatively compact, easily transportable package.

9 Claims, 9 Drawing Sheets

FOLDING KAYAK

CROSS-REFERENCE TO RELATED APPLICATION

The present application claims priority from United States Provisional Application No. 60/821,699, filed Aug. 7, 2006. The contents of that provisional application are incorporated herein by reference.

FIELD OF THE INVENTION

The present invention relates to a collapsible boat, such as a kayak, in which a skin or shell of water impermeable material covers an internal framework of rigid members. The rigid members are configured for ease of assembly of the boat.

BACKGROUND OF THE INVENTION

The present inventor is a named inventor on two other patents which describe prior approaches to provision of a collapsing or foldable boat. Those patents are U.S. Pat. Nos. 5,875,731 and 6,371,042. Those prior approaches had several disadvantages, making the boat more difficult to assemble and operate.

SUMMARY OF THE INVENTION

In one aspect, the invention provides a collapsible boat which has fore and aft hull assemblies which can be joined together by one or more adjustment mechanisms, those mechanisms facilitating adjustment of the boat's keel, thereby allowing the boat to sit differently in the water, and promoting either greater turning ability or greater lateral stability, depending on the degree of curvature of the keel. Those mechanisms also facilitate adjustment of the port or starboard gunwale, thereby aiding the user to steer in different kinds of cross currents. In a particular aspect, the adjustment mechanism herein provides advantages compared to the adjustment mechanisms that the above-referenced US patents describe.

The inventive kayak includes a water impermeable skin which in one embodiment is a urethane (such as polyurethane) with a mesh framework which can be nylon or Kevlar, or other flexible material with satisfactory tensile strength characteristics. In one embodiment, the skin may be heat treated to promote a predetermined shape upon assembly. The skin has favorable memory characteristics, meaning that if the skin is stretched, for example, to provide greater keel curvature, when the frame is retracted, the skin will return to its original shape and size. By being heat treated (using a process known as thermoforming), the altered shape of the mesh framework can be held, upon cooling, to the desired predetermined shape.

In one embodiment, the inventive kayak also has an adjustable seat whose position within the kayak can be adjusted to accommodate users of different heights.

In accordance with another aspect of the invention, to make assembly easier, respective fore and aft gunwale, chine, keel, and deck portions are elongate tubes which fit into a bow assembly and a stern assembly, respectively, to form fore and aft subassemblies which then are placed easily into the fore and aft ends of the water impermeable skin. Ribs are positioned appropriately in those fore and aft subassemblies. The overall kayak kit thus has a minimal number of pieces for the user to put together, thus facilitating assembly.

With the foregoing aspects, the assembled kayak will have the favorable characteristics of a rigid-body kayak (or actually, of a plurality of different rigid body kayaks), while at the same time being disassembled into a relatively compact, easily transportable package. The improved adjustability of the kayak enables the user effectively to possess a number of different kayaks with different operational characteristics, suitable for open-ocean or closed-water environments as desired. The resulting craft has all of the advantages of both hard shell and skin on frame kayaks, with none of the disadvantages.

The inventive kayak accommodates a wide range of water and wind conditions, which can change constantly. At the same time, the kayak accommodates the varied skill levels of kayakers. The inventive kayak provides substantially instantaneous, on-demand, customized control of the hull shape, right from the cockpit.

BRIEF DESCRIPTION OF THE DRAWINGS

Various aspects of the invention now will be described in detail with reference to the accompanying drawings, in which.

DETAILED DESCRIPTION OF EMBODIMENTS

Figure 1:
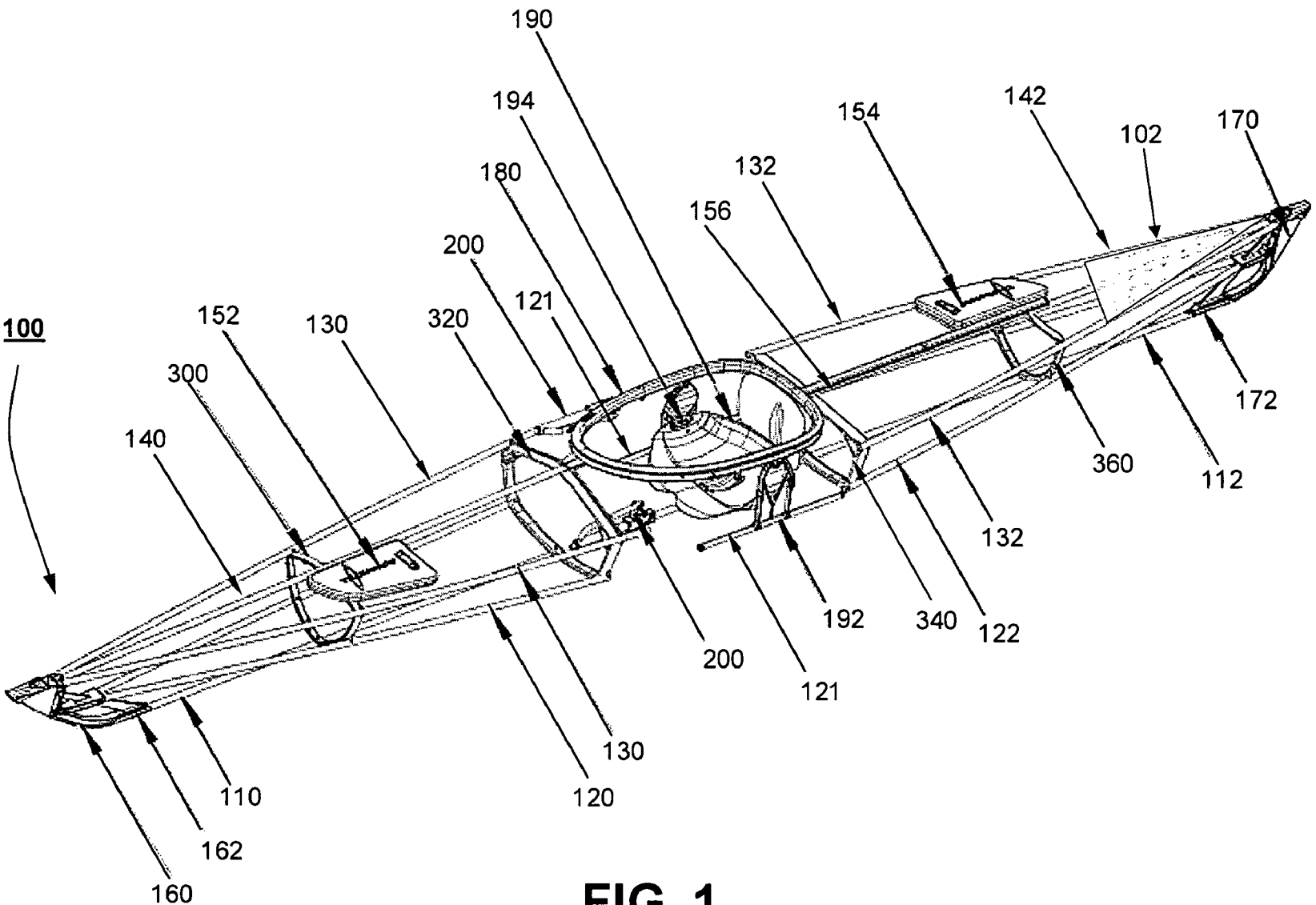
FIG. 1 is a perspective view of one embodiment of a folding kayak in accordance with the invention.
Figure 2A:
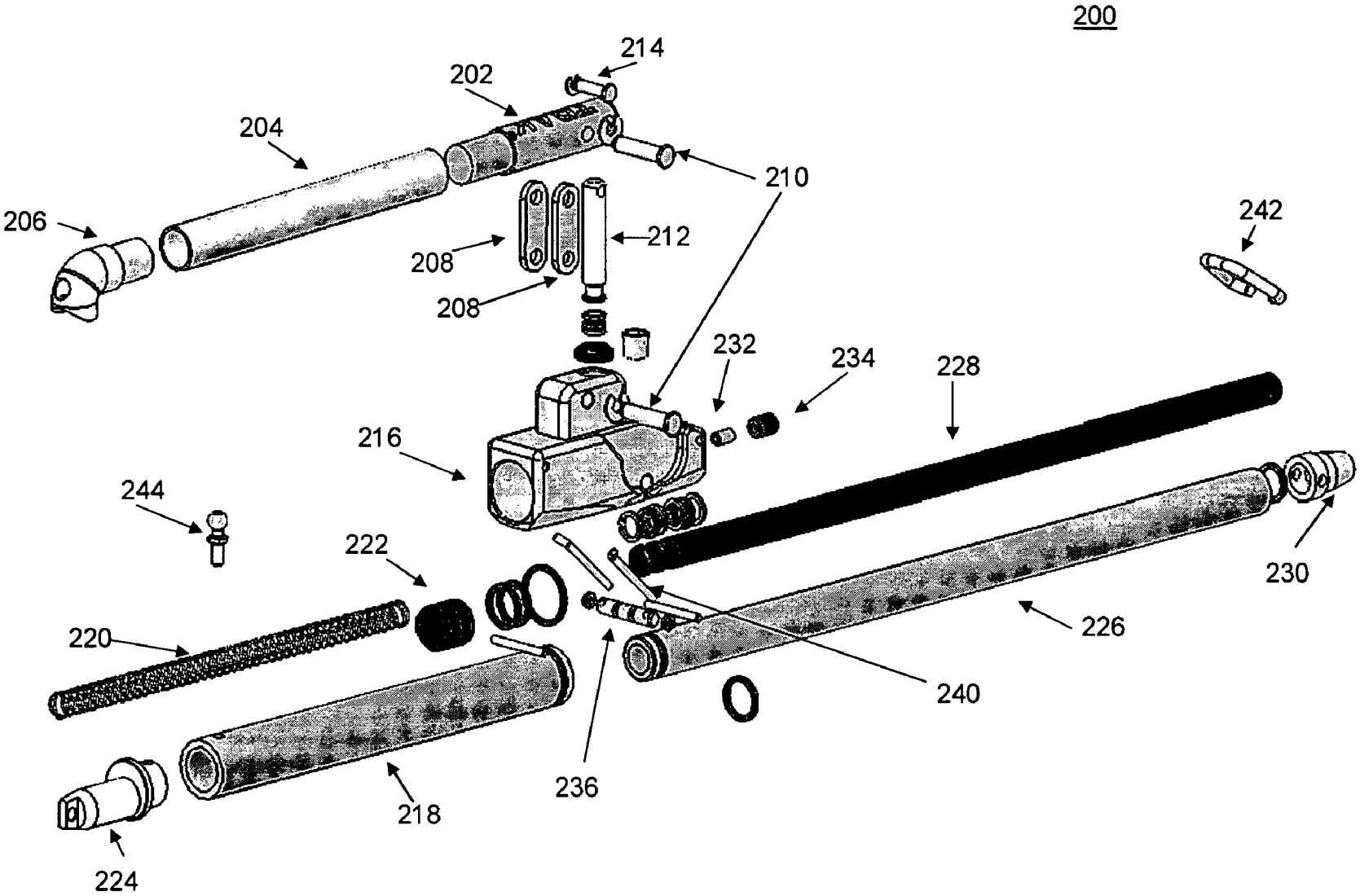
FIGS. 2A and 2B are exploded view of an adjustment mechanism in accordance with embodiments of the invention.
Figure 2B:
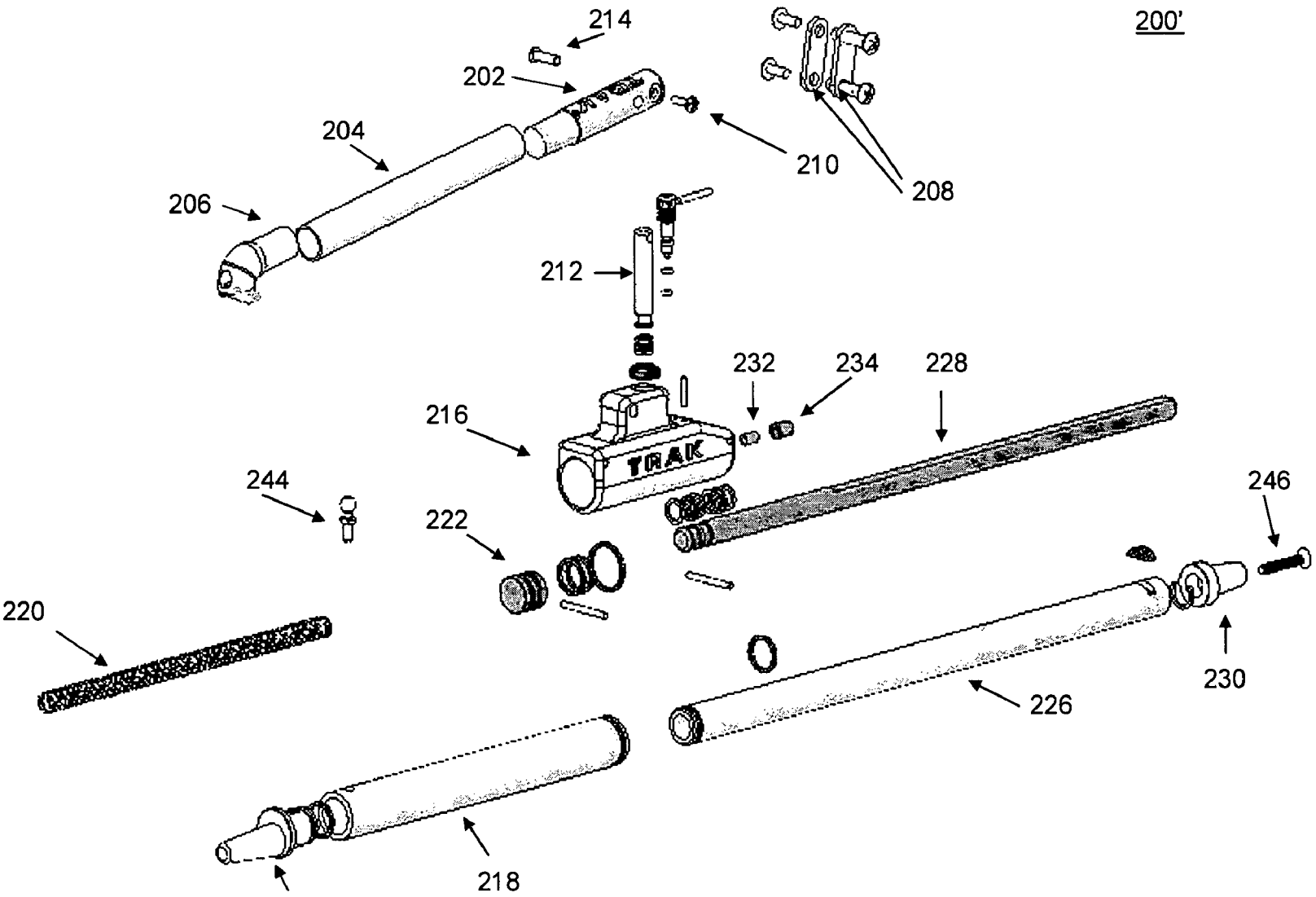

FIG. 1 shows the overall frame assembly 100 for the inventive folding kayak. A forward keel portion 110 and aft keel portion 112 are shown. In one embodiment, these two pieces are joined, as are other pieces of the kayak as will be described, via an hydraulic jack assembly 200, 200' (FIGS. 2A and 2B).

Forward and aft chine portions 120, 122, are provided on the port and starboard sides of the kayak. The fore and aft chine portions on each side are joined by respective central chine portions 121. Forward and aft gunwale portions 130, 132 also are provided on the port and starboard sides of the kayak. In one embodiment, one or more of these sets of forward and aft gunwale portions are joined by an hydraulic jack 200, 200'. Where a jack assembly 200, 200' is not provided, central gunwale or keel portions may be substituted, similarly to the central chine portions 121.

Figure 4:
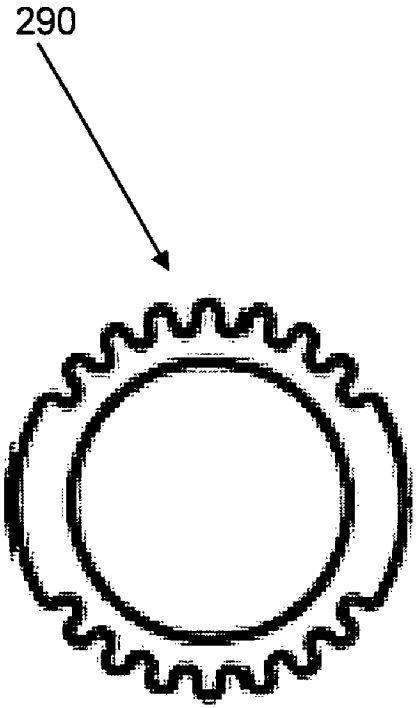
FIG. 4 is a cross-sectional view of one embodiment of a spline for connecting portions of the inventive kayak.

The fore and aft keel portions 110, 112 (with a jack 200, 200'); chine portions 120, 121, 122; and gunwale portions 130, 132 (with a jack 200, 200') may be joined by respective splines 290. A cross-section of a spline 290 is shown in FIG. 4. Each spline 290 is sufficiently elongate, and appropriately dimensioned to fit snugly within the diameter of the chine, keel, and gunwale portions, and also to provide a snug fit of the jack assemblies with the keel and gunwale portions. The splines 290 are corrugated, as shown. One advantage of the corrugation is a facilitated snug fit. Another advantage, particularly in corrosive or deposit-building environments such as encountered in salt-water kayaking, is that rotation of the corrugated splines within their respective chine, keel, or gunwale portions will aid in removal of corrosion or build-up, without the need for repeated lubrication or other maintenance.

The kayak is covered with a skin 102 (shown in a sort of sectional view as a partially transparent triangular shape in part toward the stern portion of the kayak) which in one embodiment may be polyurethane with a mesh weave such as nylon or Kevlar™. The skin should be durable and resilient, but should have relatively little memory, so that when it is stretched for purposes of adjusting the keel or one or more gunwales, the material will not remain in its stretched position, but rather will return to its original configuration or shape. In one embodiment, the skin 102 may be heat treated, using a process known as thermoforming, so that the configuration of the mesh is altered slightly, to conform to the shape of the frame when the frame is inserted into the kayak. However, thermoforming is not critical to the assembly and operation of the kayak.

As also shown in FIG. 1, there are fore and aft deck portions 140, 142. One or both of these deck portions, as well as the gunwale portions 130, 132, the chine portions 120, 122, and keel portions 110, 112, may be made of a suitable lightweight, strong material, such as aluminum or magnesium, including but not limited to (in one embodiment) aerospace grade anodized aluminum. Selection of appropriate gauge for this tubular material, among other physical characteristics, will be known to those skilled in the art. Where appropriate, it may be possible to use graphite or other similar material for these portions. Materials which are not overly brittle, and which are sufficiently impact resistant to withstand damage under the kind of conditions that kayakers can experience, will be particularly suitable.

One or more access hatches 152, 154 may be provided, to provide access to fore or aft portions inside the kayak, thus enabling the user to access storage areas to store gear.

FIG. 1 also shows a bow assembly 160 and bow assembly connector 162. In one embodiment, to facilitate assembly, the bow assembly 160 and bow assembly connector 162 may be connected to the forward portions of the gunwale, chine, and keel, providing a single unit which the user can assemble by connecting ribs 300, 320 (FIGS. 3A and 3B), as will be discussed. FIG. 1 further shows a stem assembly 170 and stem assembly connector 172. In one embodiment, to facilitate assembly, the stem assembly 170 and stem assembly connector 172 may be connected to the aft portions of the gunwale, chine, and keel, providing a single unit which the user can assemble by connecting ribs 340, 360 (FIGS. 3C and 3D), as also will be discussed.

As noted above, FIG. 1 shows ribs 300, 320, 340, and 360 (FIGS. 3A-3D). These ribs are joined to the fore and aft assembly portions as part of the overall assembly of the kayak. To facilitate assembly, the ribs may have openings which mate with corresponding protrusions in the respective, appropriate fore and aft gunwale, chine, and keel portions. Alternatively, as would be known to those skilled in the art, the ribs may have respective protrusions which mate with holes in the respective fore and aft portions of the deck portions, gunwales, chines, and keel. As a still further alternative, as will be discussed below with respect to FIGS. 3A-3D, the ribs may be formed with appropriate openings into which the deck, gunwale, chine, and keel portions may be forced or press fit. In one aspect, the ribs may include a ball stud receiver piece, provided as an insert in the ribs, and allowing for tuning the resistance for inserting and removing ball stud connectors during kayak assembly and disassembly. As yet a further alternative, the ribs may be formed with openings that are more closed-ended than is shown in FIGS. 3A-3D, so that the deck, gunwale, chine, and keel portions may be inserted through those openings. The openings may be completely closed, or partly open. Other ways of mating the ribs to the fore and aft gunwale, chine, and keel portions will be apparent to those skilled in the art, so as to mate the ribs to the rest of the assembly, and thus add rigidity to the overall kayak.

While various rib attachment approaches may be apparent to the ordinarily skilled artisan, an important consideration is the ability to assemble and disassemble the kayak without fatiguing the attachment means on either the rib or the deck, gunwale, chine, or keel portions. As the ribs may be made, for example, of a rigid plastic material, it appears that having openings in the ribs, rather than protrusions, may make the assembly most resistant to fatiguing or wearing out of the parts that have to be attached to each other. Providing metal protrusions on the deck, gunwale, chine, and keel portions would be suitable.

One aspect of the ribs shown in FIGS. 3A-3D is that, as shown, the ribs have a relatively flat profile, and thus are more flexible than ribs used in conventional kayaks. Previous approaches to forming these ribs have emphasized stiffness over resilience. As a result, the ribs have been thicker in profile.

The ribs shown in FIGS. 3A-3D have at least two advantages. First, their lower profile makes it easier to store gear fore and aft, because it is not necessary to slide gear over relatively tall impediments. Second, while the profile shown provides favorable stiffness characteristics, this profile also provides resilience to cope with aggressive wave conditions, and also to cope better with obstructions that a kayaker can encounter. Flexing and conforming with waves, rather than plowing through them, provides more favorable performance. Running into rocks and the like can cause varying degrees of damage, but the greater resilience of the overall assembly of the inventive kayak makes the kayak more resistant to damage.

FIG. 1 also shows a seat 190 with a pillar 192 and a seat adjustment portion 194. The seat 190, pillars 192, and seat adjustment portions 194 are positioned within coaming 180, which fits as part of the overall kayak 100. Coaming 180 (shown in more detail in FIG. 5A) defines part of a cockpit in the kayak. The seat 190 may be positioned in various locations within the kayak 100 to accommodate different user heights.

Figure 5B:
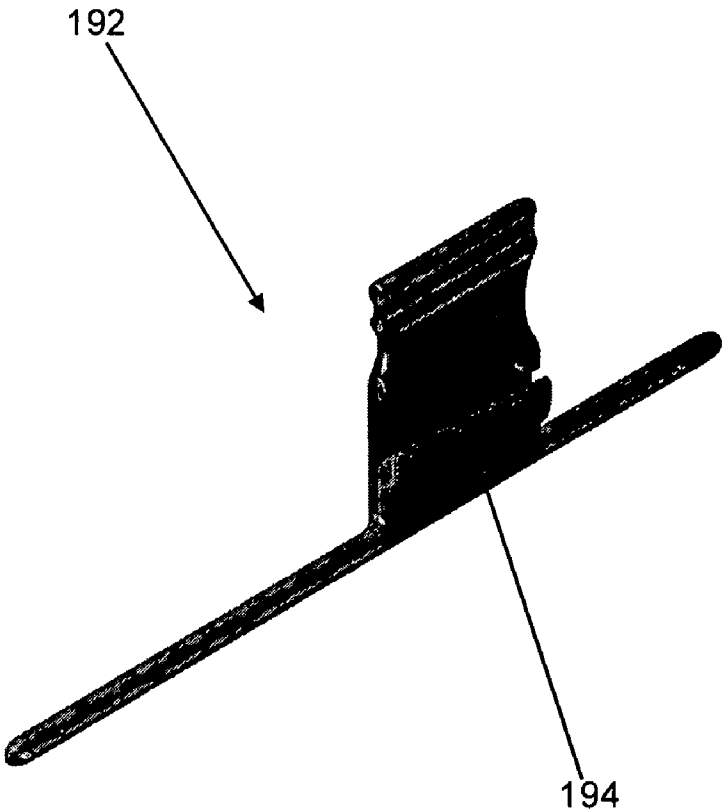
FIG. 5B is a perspective view of a pillar that fits with the coaming in the cockpit of the kayak.
Figure 5A:
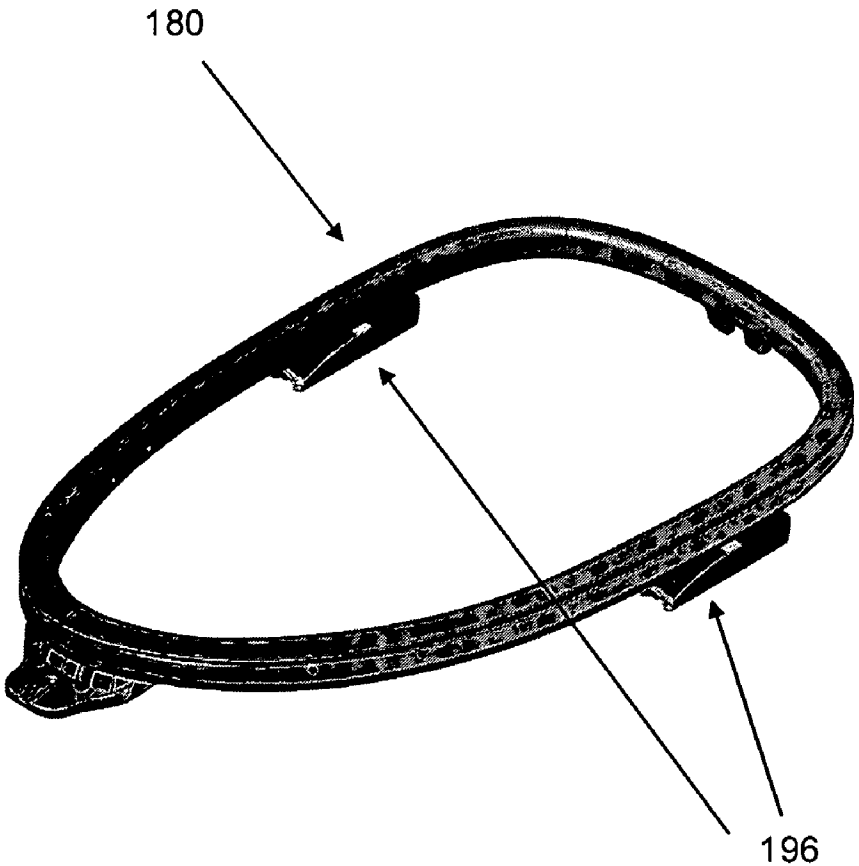
FIG. 5A is a perspective view of a coaming.

FIG. 5B shows a pillar 192 and seat adjustment portion 194 in more detail. Pillars 192 (one on each side of the kayak)) mate with respective receiving portions 196 in coaming 180 (FIG. 5A). Seat 190 locks in place simply by sliding it back and snapping it down on seat adjustment portions 194, and unlocks by lifting up on the seat to release it from portions 194. Receiving portions 196 in coaming 180 may be adjustable locking sliders which can be moved forward and backward, thereby defining locations of pillars 192, and then bolted in place. In another embodiment, the seat may have pegs which fit into differently-placed holes in pillars 192. Depending on the hole that the user selects, the seat may be positioned more forwardly in the cockpit, or farther back. As one alternative, the seat may have holes which mate with one of a set of pegs in pillars 192. As further alternatives, the plurality of holes or pegs may be placed on either side of seat 190, to mate with corresponding pegs or holes in pillars 192. Other attachment and adjustment alternatives will be apparent to those skilled in the art.

FIGS. 2A and 2B show exploded views of embodiment of a jack 200, 200', in which like elements have the same numbering. Anywhere from one to three such jacks may be provided as part of the overall kayak. To adjust the keel, one such jack 200, 200' may be placed in the bottom, to which the fore and aft keel portions 110, 112 are joined. Operation of the jack 200, 200' will drive the fore and aft keel portions away from each other, causing the ends of the kayak to turn upwardly and adjusting the rocker of the kayak.

To help the user compensate for differing cross-current and cross-wind conditions, additional jacks 200, 200' may be provided on the left and/or right hand side of the overall assembly, joining the respective fore and aft gunwale portions 130, 132. By actuating a jack on the port or starboard side of the kayak, it is possible to alter the yaw of the boat. In this manner, it is possible to alter the length and arc of the kayak. As a result, a rudder, or skeg, is not necessary.

In one embodiment, the jack 200, 200' is an hydraulic jack with a handle 202, housing 216, reservoir tube 218, and ram tube 226, among other parts, as will be discussed in greater detail with respect to FIGS. 2A and 2B. When the handle 202 is operated, ram tube 226 extends, pushing apart the fore and aft portions of the members which the jack mates. Thus, to adjust the rocker on the kayak, the fore and aft keel portions 110, 112 may be pushed apart, thereby causing greater curvature in the keel. As a result of the curvature of the keel, the fore and aft portions of the kayak extend upwardly away from the water. When the jack is released, the portions return to their normal configuration and alignment. The skin 101 returns to its original shape. To adjust the yaw on the kayak, the fore and aft gunwale portions 130, 132 on either the port or starboard sides may be pushed apart, thus changing the length and arc of the kayak.

Looking at one embodiment of jack 200, 200' in FIGS. 2A and 2B in more detail, handle 202 has handle tube 204 attached to it, and a handle end 206 attached to the end of that, for ease of gripping and operation. Handle pins 210 attach handle links 208 to housing 216. Piston pin 214 attaches piston 212 to handle 202. Piston 212 in turn fits into housing 216. Pump action of handle 202 causes piston 212 to move in and out of housing 216.

Reservoir tube 218 fits into one end of housing 216, and ram tube 226 fits into the other end of housing 216. Reservoir spring 220 fits into reservoir tube 218, and presses against reservoir piston 222 which fits within reservoir tube 218. Reservoir shoulder 224 closes off one end of reservoir tube 218, and is secured to reservoir tube 218 with ball stud 244.

Ram 228 fits into ram tube 226, and also has a smaller diameter than reservoir tube 218 as shown, so as to fit into reservoir tube 218. A ram shoulder 230 is secured at the end of ram tube 226 by D-link 242 (FIG. 2A) or by screw 246 (FIG. 2B).

Various O-rings (shown in the Figures, but unnumbered) seal the various portions of the reservoir tube 218 and ram tube 226 within housing 216. Check valves 232 and 234 serve to hold the jack 200 in an extended position when the user operates the handle 202. In FIG. 2A, ball valve 236 cooperates with pin-valve handles 240 to actuate the ram. Other ram actuation mechanisms for either the FIG. 2A or FIG. 2B embodiment will be apparent to ordinarily skilled artisans, and so need not be detailed here.

When one of the jacks that mates the fore and aft gunwale portions on either the port or starboard sides is operated, that side of the kayak will be extended, thus affecting the turning capabilities of the kayak. When the jack is released, the fore and aft gunwale portions will then return to their original configuration and alignment, and the skin 101 will return to its original shape. Likewise, when one of the jacks that mates the fore and aft keel portions is operated, the curvature of the keel will change. The keel will be lengthened, thus causing the ends of the kayak to turn upwardly, thus changing the curvature of the keel. Again, when that jack is released, the fore and aft keel portions will return to their original position, and the skin 101 will return to its original shape.

Figure 3A:
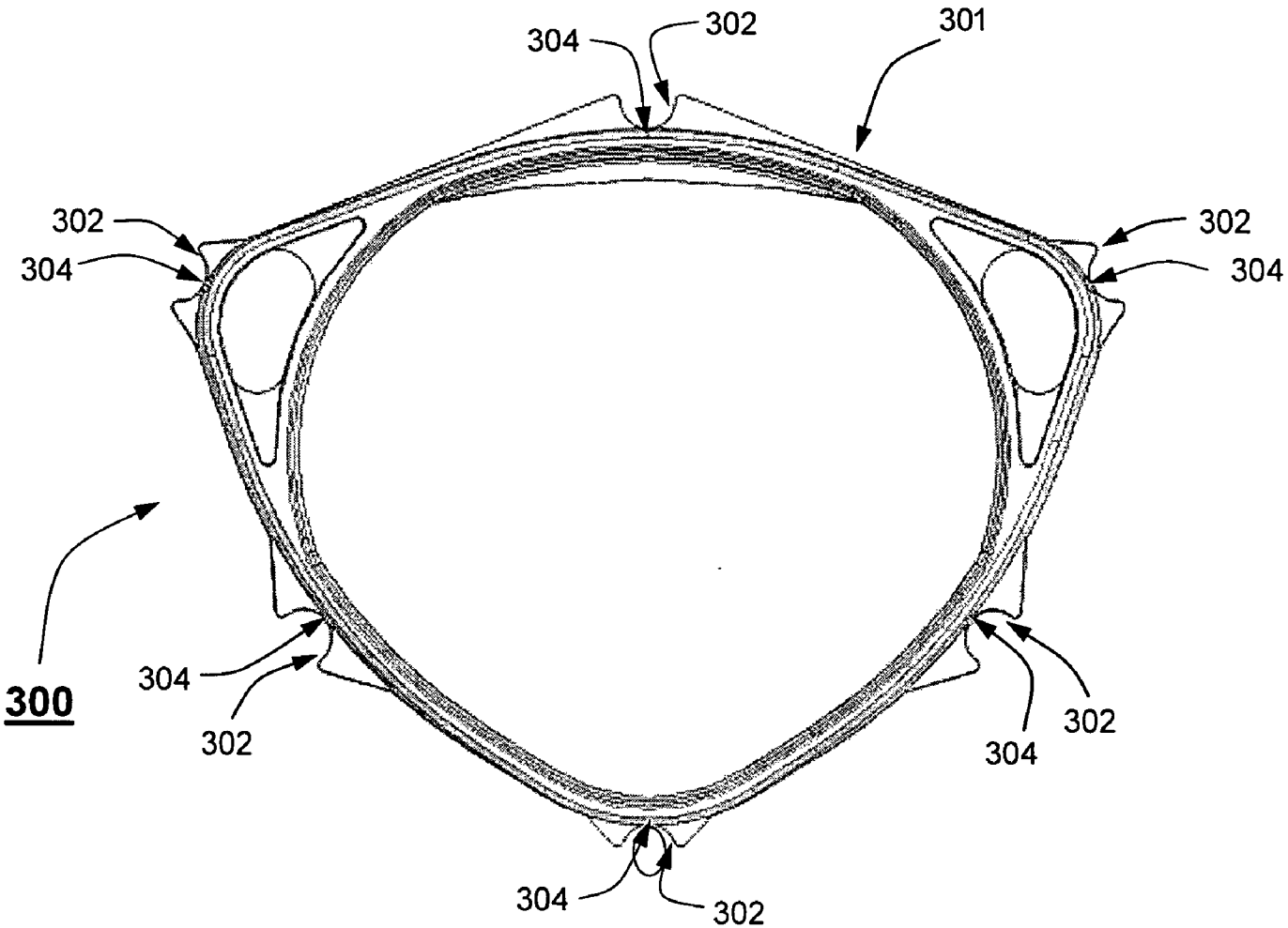
FIGS. 3A-D are views of ribs which form part of the assembled kayak in accordance with one embodiment of the invention.

FIGS. 3A-3D show the respective ribs 300-360. In FIG. 3A, forward rib 300 has a frame 301 and a plurality of indentations 302, which mate with respective deck, chine, gunwale, and keel portions. In one embodiment, openings 304 accommodate corresponding protrusions on the deck, chine, gunwale, and keel portions in the forward part of the kayak assembly, to mate the rib to those portions. As known to ordinarily skilled artisans, the positions of the protrusions and openings may be reversed, so that the protrusions are provided on the rib rather than on the respective chine, gunwale, keel, and deck portions. As discussed, the overall goal is to provide ease of assembly and sturdiness and stability through repeated assembly and disassembly operations. Other attachment techniques will be apparent to those skilled in the art.

Figure 3B:
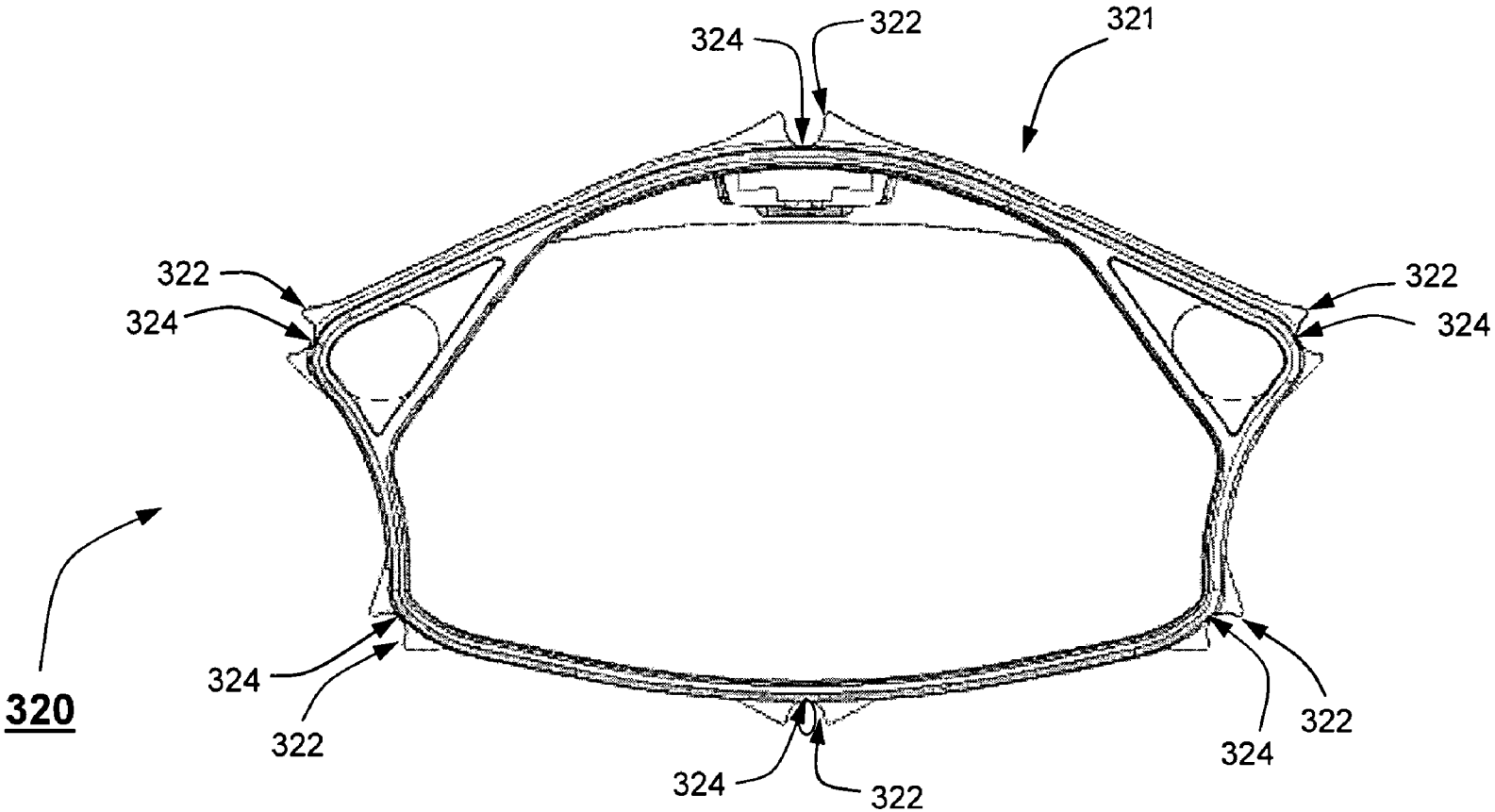

Similarly to FIG. 3A, FIG. 3B shows a more central rib 320 with a plurality of indentations 322 and openings 324 around a frame 321, for similar mating purposes with respective forward portions of the deck, chine, gunwale, and keel portions. In one embodiment, this rib 320 may be placed just forward of the coaming 180.

Figure 3C:
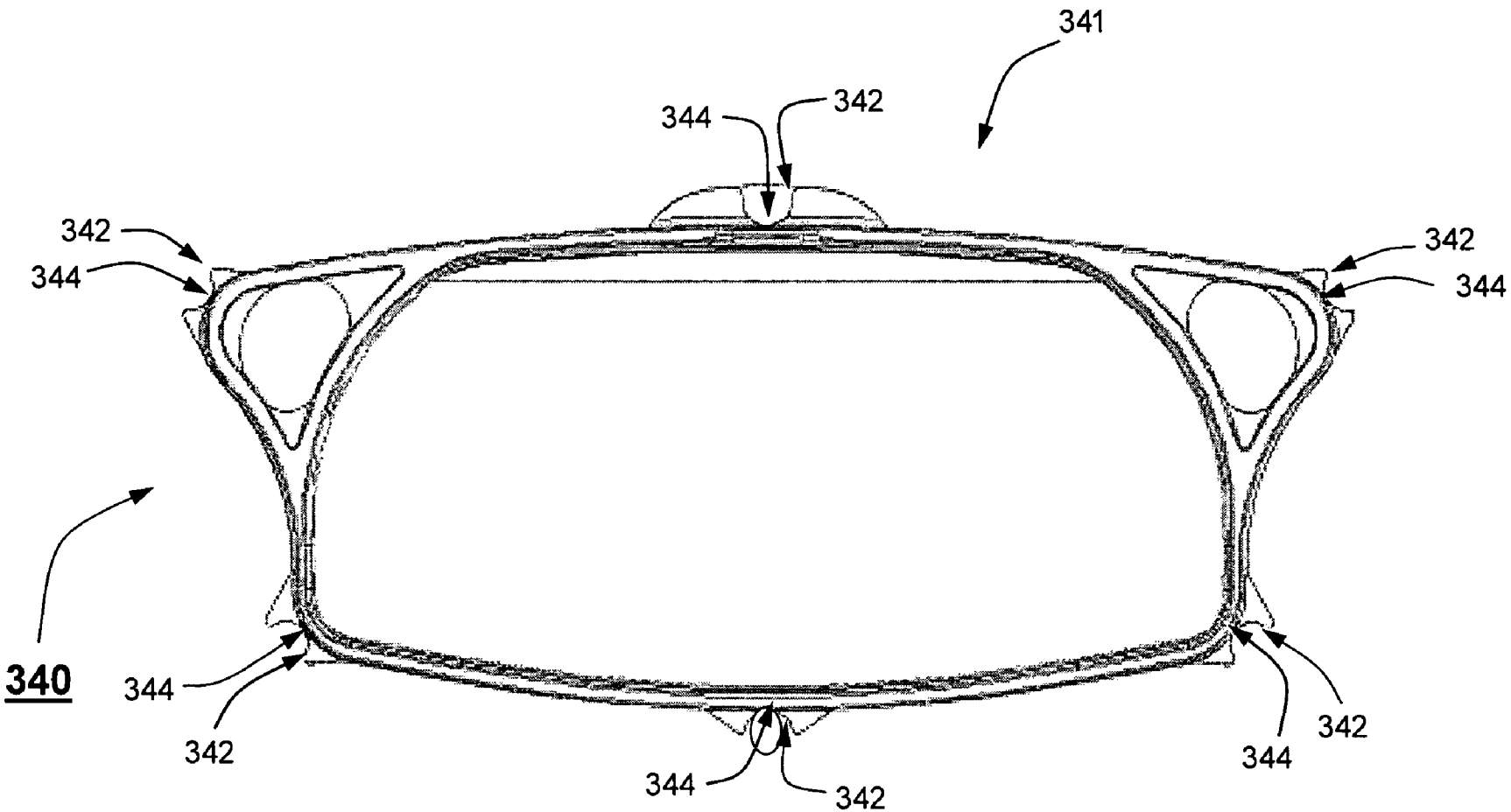

FIG. 3C similarly shows a relatively central rib 340 with a plurality of indentations 342 and openings 344 around a frame 341, this time to accommodate aft portions of the deck, chine, gunwale, and keel portions. Attachment may be achieved as in the same manner as with the ribs in FIGS. 3A and 3B. In one embodiment, the rib 340 is positioned just behind the coaming 180 in the overall frame.

Figure 3D:
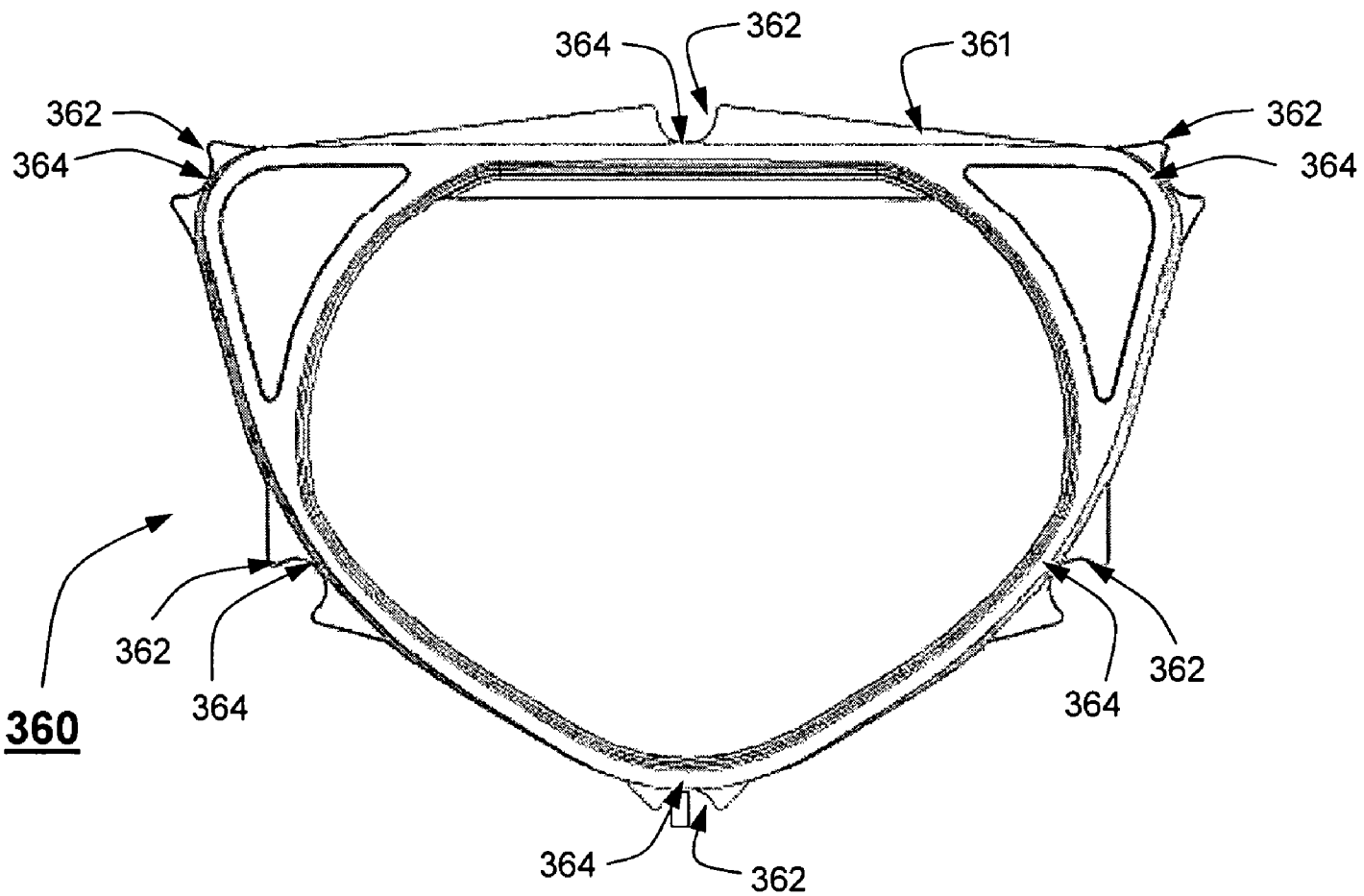

FIG. 3D shows a fourth, rearwardly positioned rib 360 with a plurality of indentations 362 and openings 364 around a frame 361. This rib also accommodates appropriate portions of the deck, gunwale, chine, and keel, members. This rib is positioned between the coaming 180 and the stern assembly 170.

Various appropriate positions of the ribs 300-360 will be apparent to those of ordinary skill in the art, based on considerations of ease of assembly, strength, and rigidity of the overall frame. Materials for the ribs may be selected as appropriate, to provide necessary and appropriate torsional rigidity, also taking into account ease of fabrication. FIGS. 3A-3D show various openings in the ribs. These openings help to lighten the ribs without sacrificing significant strength. The openings likewise may be varied, as will be known to ordinarily skilled artisans.

Figure 6:
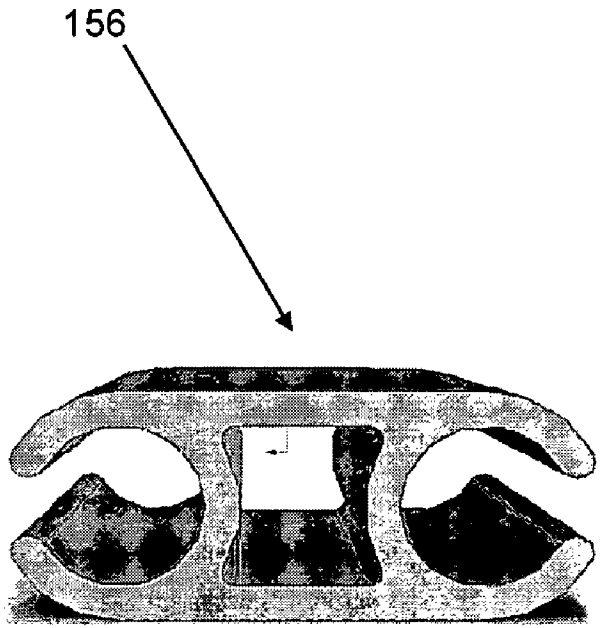
FIG. 6 is a cross-sectional view of a keder assembly.

As another aspect of the invention, not shown specifically herein but described, for example, in FIGS. 9-11 and col. 8, lines 2-12 of U.S. Pat. No. 6,371,042, this portion being incorporated herein by reference, the skin 102 may have a central cockpit opening and one or more deck slits extending from the cockpit opening into the fore and aft sections of the kayak to allow for enlargement of the cockpit opening to permit the hull sections to be inserted into the skin 102. FIG. 1 shows a keder assembly 156 which may be used to close the deck slit. A cross-section of keder assembly 156 is shown in FIG. 6. The sides of the deck slit may have a keder (a cord or rope around which the material of skin 102 is wrapped, forming a protruding piece) which fits in keder assembly 156).

While the inventive kayak has been described herein with reference to a number of embodiments, various modifications within the scope and spirit of the invention will be apparent to ordinarily skilled artisans. Therefore, the invention should be considered as limited only by the scope of the following claims.

What is claimed is:

1. A folding kayak comprising:

a forward hull assembly comprising a first plurality of pre-assembled elongate longitudinal frame members, including a forward keel portion, port and starboard forward gunwale portions, port and starboard forward chine portions, and a forward deck portion;

an aft hull assembly comprising a second plurality of pre-assembled elongate longitudinal frame members, including an aft keel portion, port and starboard aft gunwale portions, port and starboard aft chine portions, and an aft deck portion;

a plurality of corrugated splines connecting said forward and aft port chine portions and said forward aft starboard chine portions;

wherein at least said forward and aft port chine portions and said forward and aft starboard chine portions comprise elongate tubes, said corrugated splines fitting snugly for rotation within and extending from said elongate tubes to make the connections, wherein rotation of said splines within said elongate tubes facilitates removal of deposits at ends of said elongate tubes;

a plurality of forward ribs connected at predetermined locations to said first plurality of pre-assembled elongate longitudinal frame members;

a plurality of aft ribs connected at predetermined locations to said second plurality of pre-assembled elongate longitudinal frame members;

a unitary flexible water-impermeable skin for covering said forward and aft hull assemblies;

a first hydraulic jack mechanism connecting said forward and aft keel portions, actuation of said first hydraulic jack mechanism causing adjustable separation of said forward and aft keel portions within said skin to as to vary a rocker of said kayak;

a second hydraulic jack mechanism connecting one of said forward and aft port gunwale portions or said forward and aft starboard gunwale portions, actuation of said second hydraulic jack mechanism causing adjustable separation of the gunwale portions connected with said second hydraulic jack mechanism so as to vary a yaw of said kayak.

2. A kayak as claimed in claim 1, further comprising a third hydraulic jack mechanism so that the forward and aft port gunwale portions and the forward and aft starboard gunwale portions are connected by respective hydraulic jack mechanisms, actuation of said second and/or third hydraulic jack mechanism causing adjustable separation of the respective connected gunwale portions so as to vary a yaw of said kayak.

3. A kayak as claimed in claim 2, wherein each of said hydraulic jack mechanisms comprises:

a housing;

a piston that fits in said housing;

a handle for actuating said piston;

a reservoir tube fitted into one end of said housing, and having a reservoir shoulder closing off one end of said reservoir tube;

a reservoir piston fitted within said reservoir tube;

a reservoir spring fitted within said reservoir tube and pressing against said piston a ram tube fitted into an opposite end of said housing;

a ram fitted into said ram tube; and check valves for holding said piston in an extended position in response to operation of said handle.

4. A kayak as claimed in claim 1, wherein said skin is provided with a central, cockpit opening, and deck slits extending toward said fore and aft hull assemblies, said kayak further comprising a keder assembly for each of said deck slits, sides of each of said deck slits comprising a keder fitting into a respective side of a respective keder assembly so that each of said deck slits may be opened for assembly of said kayak, and closed to ensure integrity of said skin.

5. A kayak as claimed in claim 1, further comprising a coaming defining at least part of a cockpit of said kayak, and removable seat positioned in said coaming and having a pair of pillars and seat adjustment portions, wherein said pillars mate with respective receiving portions in said coaming, and wherein said removable seat mates with said seat adjustment portions.

6. A kayak as claimed in claim 5, wherein said removable seat locks with said seat adjustment portions by sliding said removable seat back and snapping it down on said seat adjustment portions, and unlocks by lifting up on said removable seat to release it from said seat adjustment portions.

7. A kayak as claimed in claim 5, wherein said receiving portions in said coaming comprise adjustable sliders which are movable along said coaming to define locations for said pillars when said pillars are mated with said sliders.

8. A kayak as claimed in claim 1, wherein said forward and aft ribs have a flat profile to provide flexible rigidity and resilience to said kayak when said kayak is assembled, to promote resistance to damage when contacting water obstructions, and to provide improved performance in adverse water conditions.

9. A kayak as claimed in claim 8, wherein said flat profile also facilitates stowage of gear in forward and aft portions of said kayak.

* * * * *